US006325026B1

(12) United States Patent
Suzuki

(10) Patent No.: US 6,325,026 B1
(45) Date of Patent: Dec. 4, 2001

(54) COOLING WATER RECIRCULATION APPARATUS FOR AN INTERNAL COMBUSTION ENGINE

(75) Inventor: Makoto Suzuki, Mishima (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/145,197

(22) Filed: Sep. 1, 1998

(30) Foreign Application Priority Data

Oct. 9, 1997 (JP) ..... 9-277778

(51) Int. Cl.[7] ..... F02N 17/47
(52) U.S. Cl. ..... 123/41.1; 123/142.5 R
(58) Field of Search ..... 123/41.1, 142.5 E, 123/142.5 R

(56) References Cited

U.S. PATENT DOCUMENTS

| | | | | |
|---|---|---|---|---|
| 3,877,443 | * | 4/1975 | Henning et al. | 123/41.08 |
| 5,095,855 | * | 3/1992 | Fukuda et al. | 123/41.44 |
| 5,103,774 | * | 4/1992 | Hirata et al. | 123/41.1 |
| 5,111,774 | * | 5/1992 | Hiramoto et al. | 123/41.1 |
| 5,121,714 | * | 6/1992 | Susa et al. | 123/41.1 |
| 5,189,991 | * | 3/1993 | Humburg | 123/41.1 |
| 5,215,044 | * | 6/1993 | Banzhaf et al. | 123/41.29 |
| 5,427,062 | * | 6/1995 | Chamot et al. | 123/41.1 |
| 5,692,460 | * | 12/1997 | Froeschl et al. | 123/41.1 |
| 5,749,330 | * | 5/1998 | Inque et al. | 123/41.1 |
| 6,047,676 | * | 4/2000 | Trapy | 123/142.5 R |

FOREIGN PATENT DOCUMENTS

| | | |
|---|---|---|
| 98117410.5-2311 | 9/1922 | (EP) . |
| 59-14706 | 1/1984 | (JP) . |
| 59-119010 | 7/1984 | (JP) . |

* cited by examiner

*Primary Examiner*—Willis R. Wolfe
*Assistant Examiner*—J A Benton
(74) *Attorney, Agent, or Firm*—Kenyon &Kenyon

(57) ABSTRACT

To accelerate a warming-up operation of an internal combustion engine and to quickly elevate a temperature of cooling water, a radiator side cooling water recirculation circuit E for recirculating the cooling water between an engine body 3 and a radiator 5, a heater side cooling water recirculation circuit F for recirculating the cooling water between the engine body 3 and a heater core 7, and a radiator bypass circuit G for recirculating the cooling water bypassing the radiator 5 are provided. A flow passage switching valve 15 is provided at a place where an engine body directed communication passage 14 and a radiator bypass passage 19 are merged into one flow, for allowing the cooling water to flow through the radiator side cooling water recirculation circuit E when the temperature of the cooling water exceeds a radiator water passage allowance temperature $T_1$ and for allowing the cooling water to flow through the radiator bypass circuit G when the temperature thereof is not higher than the radiator water passage allowance temperature $T_1$. A flow rate control valve 23 is provided in a midway of a heater core directed communication passage 21, for reducing an amount of the cooling water flowing to the heater core 7 when the temperature of the cooling water is not higher than a heater water passage limit temperature $T_2$. An electric heater 34 is provided within a water jacket 12.

6 Claims, 5 Drawing Sheets

COOLING WATER RECIRCULATION APPARATUS FOR AN INTERNAL COMBUSTION ENGINE

BACKGROUND OF THE INVENTION

1. Field of the Invention

The present invention relates to a cooling water recirculation apparatus for an internal combustion engine.

2. Description of the Related Art

In a cooling water recirculation apparatus for an internal combustion engine, heat irradiated from an internal combustion engine body is absorbed by cooling water, and a part of the absorbed heat is utilized as a heat source for a passenger room heater.

For this reason, the cooling water that has flowed through an engine interior cooling water communication passage provided in the internal combustion engine body, i.e., a so-called water jacket and that has been warmed by absorbing the heat from the internal combustion engine body during the passage is fed out from the internal combustion engine body to the passenger room heater through a heater side cooling water recirculation circuit for connecting the internal combustion engine body and the passenger room heater to each other for recirculation.

However, immediately after the starting operation of the internal combustion engine, since the cooling water is less warmed up, the passenger room heater less works.

Accordingly, for instance, Japanese Utility Model Publication Laid-Open No. Sho 59-14706 discloses a technique for providing, in a midway of the heater side cooling water recirculation circuit, a heating device for heating the cooling water by using the exhaust gas of the internal combustion engine as a heat medium, and operating the heating device upon the warming-up operation of the internal combustion engine to heat the cooling water for the passenger room heater. According to this technique, the effect of the passenger room heater upon the starting operation of the internal combustion engine is more enhanced than that of the conventional one.

However, even according to the technique disclosed in the above-described publication, since the cooling water is caused to always flow to the passenger room heater upon the warming operation, an amount of the recirculation of the cooling water is increased. Also, since the heat is radiated in the passenger room heater even if the cooling water is heated by the heating device, the heating efficiency of the overall recirculated cooling water is degraded. As a result, the enhancement of the effect of the heater is not satisfactory.

SUMMARY OF THE INVENTION

The present invention has been made in view of the above-noted defects, and therefore an object of the present invention is to accelerate a starting operation of a heater upon starting an internal combustion engine and to sufficiently accelerate the warming-up operation.

In order to attain this and other objects, according to the present invention, there is provided a cooling water recirculation apparatus for an internal combustion engine, comprising: an internal combustion engine body having a cooling water internal passage for cooling a portion around a cylinder; a radiator for irradiating heat of the internal combustion engine body, absorbed by the cooling water to atmosphere; a passenger room heater using a part of the cooling water as a heat medium; a radiator side cooling water recirculation circuit for recirculating the cooling water between the cooling water internal passage of the internal combustion engine body and the radiator; a heater side cooling water recirculation circuit for recirculating the cooling water between the cooling water internal passage of the internal combustion engine body and the heater; a radiator bypass circuit for returning the cooling water, that has been discharged from the cooling water internal passage of the internal combustion engine body, back to the cooling water internal passage, bypassing the radiator; a cooling water passage switching means for closing the radiator bypass circuit when a temperature of the cooling water exceeds a radiator water passage allowance temperature, thereby allowing the cooling water to flow through the radiator side cooling water recirculation circuit, and for closing the radiator side cooling water recirculation circuit when the temperature of the cooling water is not higher than the radiator water passage allowance temperature, thereby allowing the cooling water to flow through the radiator bypass circuit; and an auxiliary heating means for heating the cooling water, provided separately from the internal combustion engine body.

Namely, it is characterized in that: there is further provided a flow rate control valve provided downstream of the cooling water internal passage of the internal combustion engine body and upstream of the passenger room heater in the heater side cooling water recirculation circuit, for reducing an amount of the cooling water flowing through the heater side cooling water recirculation circuit when the temperature of the cooling water is not higher than a heater water passage limit temperature that is set to be not higher than the radiator water passage allowance temperature; and the auxiliary heating means is provided in a portion where the cooling water is recirculated when the temperature of the cooling water is not higher than the heater water passage limit temperature.

In this case, it is possible to employ an electric heater or a burning type heater for the auxiliary heating means.

The cooling water flow passage switching means may be a thermostat or a thermostat type flow passage switching valve for switching the flow passage by using the radiator water passage allowance temperature as a threshold value.

Also, the flow rate control valve may be a thermostat or a thermostat type flow rate control valve for opening and closing by using the heater water passage limit temperature as a threshold value. When the cooling water is warmed up so that the flow rate control valve is opened, the cooling water is recirculated through the heater side cooling water recirculation circuit, and when the cooling water is cooled so that the flow rate control valve is closed, the cooling water is not recirculated through the heater side cooling water recirculation circuit. However, the flow rate control valve does not take a structure such that no cooling water flows in the closed condition. It is preferable to allow a small amount of the cooling water to flow for detecting the temperature of the cooling water to a degree that the temperature thereof can be detected.

The heater water passage limit temperature for controlling the opening/closing of the flow rate control valve is set to be equal to or lower than the radiator water passage allowance temperature for controlling the flow passage switching of the cooling water passage switching means. Accordingly, when the flow rate control valve is closed and the cooling water is not recirculated through the heater side cooling water recirculation circuit, the radiator side cooling water recirculation circuit is always closed and the cooling water is not recirculated through this circuit but recirculated only through the radiator bypass circuit.

Accordingly, when the temperature of the cooling water is so low that the temperature of the cooling water closes the flow rate control valve as in the starting operation, the cooling water is recirculated only through the radiator bypass circuit. At this time, the cooling water flowing through the cooling water internal passage of the internal combustion engine body absorbs the heat from the internal combustion engine body and at the same time absorbs the heat from the auxiliary heating means. On the other hand, at this time, the cooling water does not flow through the heater side cooling water recirculation circuit at all and even though the water flows, the amount of the water is very small. Therefore, an amount of radiated heat from the heater is very small. Namely, since the heat which is received by the cooling water is very large and the irradiated heat from the cooling water is very small, it is possible to quickly elevate the temperature of the cooling water. As a result, it is possible to quickly elevate the temperature of the internal combustion engine body, and to shorten the warming-up time of the internal combustion engine. Also, it is possible to prevent the cold air from being brown for a long period of time into the passenger room while a temperature of the cooling water is low.

Also, when the temperature of the cooling water is elevated after the warming-up operation and the flow rate control valve is opened, a large amount of the cooling water is recirculated also through the heater side cooling water recirculation circuit. The sufficient irradiation of the heat from the heater is effected. As a result, the warmed air is fed into the passenger room. Also in this case, the cooling water absorbs the heat from the internal combustion engine body and the auxiliary heating means. Accordingly, the temperature of the cooling water at an equilibrium at which the received heat amount of the cooling water is in balance with the heat irradiation amount of the heater is high. Thus, the heat irradiation amount from the heater is increased and the passenger room heater well works.

Then, when the temperature of the cooling water is further elevated to exceed the radiator water passage allowance temperature, the cooling water passage switching means closes the radiator bypass circuit, and the flow passage is switched over so as to allow the cooling water to flow through the radiator side cooling water recirculation circuit. Then, the temperature of the cooling water is adjusted by the radiator so as to be kept at an appropriate temperature in response to the operational condition of the internal combustion engine.

DESCRIPTION OF THE PREFERRED EMBODIMENTS

Embodiments of the present invention will now be described with reference to the accompanying drawings.

Figure 1:
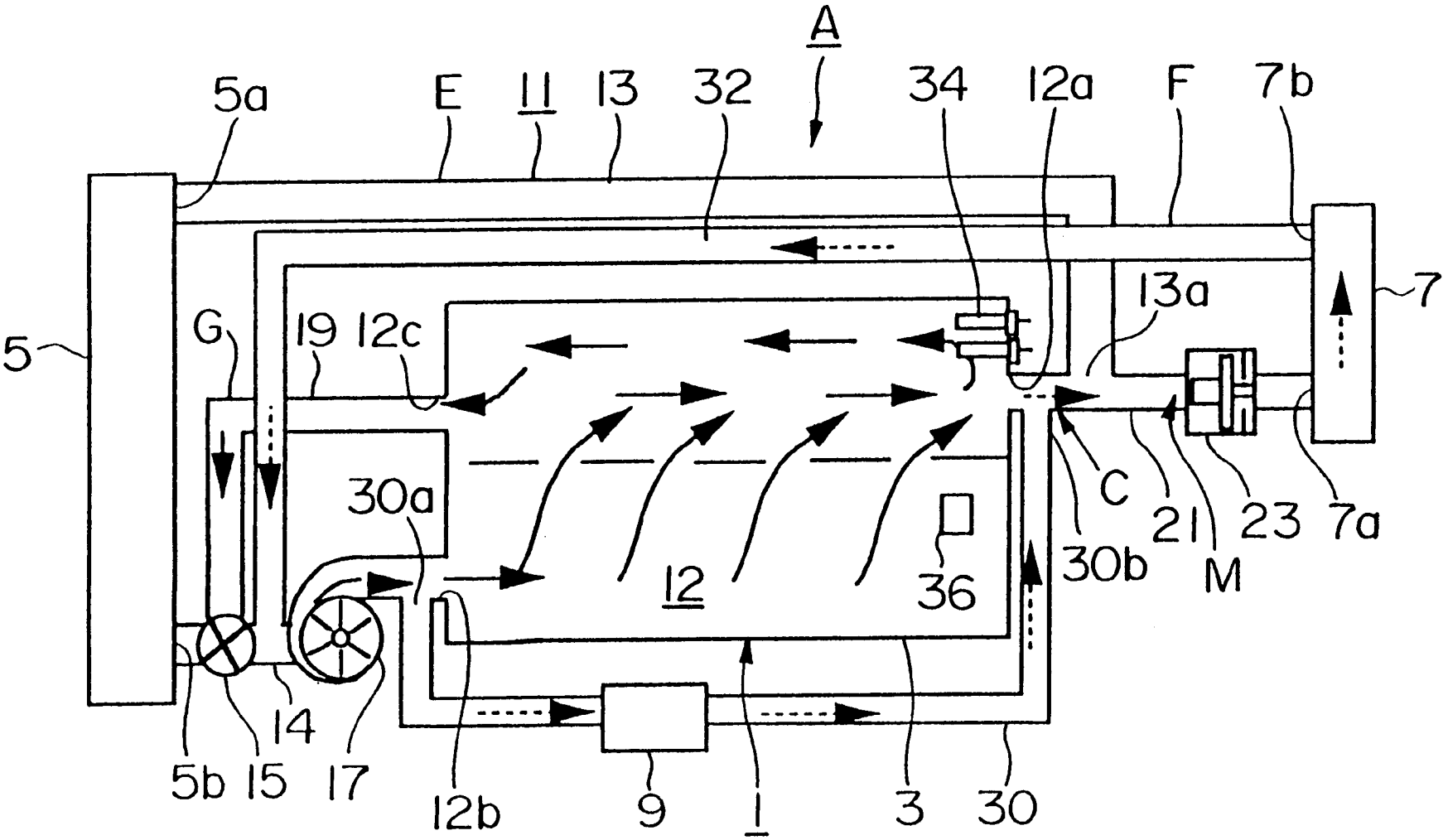
FIG. 1 is a schematic view showing a cooling water recirculation apparatus for an internal combustion engine in accordance with a first embodiment of the present invention.

As shown in FIG. 1, an engine 1 (internal combustion engine) has a radiator 5 on the left side with respect an engine body 3 as a center, a passenger room heater core 7 on the right side thereof, and an oil cooler 9 on the lower side thereof. These components 5, 7 and 9 are connected through a cooling water external passage 11 around the engine body 3. The cooling water external passage 11 is composed of respective communication passages 13, 14, 19, 21, 30 and 32 to be described in this order.

The engine body (internal combustion engine body) 3 is kept at a suitable temperature in response to the operational condition of the engine 1 by causing the cooling water (not shown) to absorb the large amount of heat generated by the drive of the engine 1. In order to attain this, a well-known water jacket (cooling water internal passage) 12 through which the cooling water flows is formed in the interior of the engine body 3.

When the heat emitted from the engine body 3 is absorbed by the cooling water while the cooling water flows through the water jacket 12, the radiator 5 irradiates the heat from the cooling water having this heat to the atmosphere. The passenger room heater core 7 uses, as a heat medium, a part of the cooling water absorbing the heat emitted from the engine body 3 to thereby provide a hot air blow into the passenger room.

The oil cooler 9 is adapted to cool the lubricant oil included in the engine 1 by using the cooling water as coolant.

The cooling water external passage 11 is adapted to communicate the engine body 3, the radiator 5, the passenger room heater core 7 and the oil cooler 9 with each other as described above and at the same time to feed the cooling water to these components.

In FIG. 1, the communication passage 13 which is a part of the cooling water external passage 11 is located above the engine body 3. Then, the communication passage 13 connects a heater side opening 12*a* of the water jacket 12 that is open to the heater core 7 side and a radiator inlet 5*a* provided on the upper portion of the radiator 5 with each other to allow the cooling water to flow from the engine body 3 to the radiator 5. Therefore, this communication passage 13 will be referred to as the radiator directed communication passage 13.

The radiator directed communication passage 13 is a passage for allowing the cooling water to pass therethrough, the cooling water absorbing and receiving the heat from the engine body 3 during the passage of the water jacket 12.

Also, the communication passage 14 that is another part of the cooling water external passage 11 is located below between the radiator 5 and the engine body 3 in FIG. 1. Then, this communication passage 14 is adapted to connect the radiator outlet 5*b* and the radiator side opening 12*b* of the engine body 3 which is open to the radiator 5 side to allow the cooling water to flow from the radiator 5 to the engine body 3. Accordingly, this communication passage 14 will be referred to as the engine body directed communication passage 14. The engine body directed communication passage 14 is provided in its midway with flow passage switching valve (cooling water passage switching means) 15 and a water pump 17 in the order from the radiator 5.

The water pump 17 is adapted to feed the cooling water to the overall cooling water external passage 11.

Also, the communication passage 19 which is still another part of the cooling water external passage 11 and which has an L-shape is provided between the flow passage switching valve 15 and a radiator side opening 12*c* located on the upper side, out of the openings of the water jacket 12 of the engine body 3 which are open on the radiator 5 side.

The communication passage 19 is a bypass passage for bypassing the radiator 5 and allowing the cooling water to flow when the temperature of the cooling water is not so high as to be cooled by passing through the radiator 5. Accordingly, the communication passage 19 will be referred to as a radiator bypass passage 19 hereinunder.

The flow passage switching valve 15 is a thermostat type switching valve. When the temperature of the cooling water exceeds a radiator water passage allowance temperature $T_1$, the radiator bypass passage 19 side of the valve is closed and the radiator 5 side of the valve is open to allow the cooling water to flow through the radiator 5. When the temperature of the cooling water is lower than the radiator water passage allowance temperature $T_1$, the radiator 5 side of the value is closed and the radiator bypass passage 19 side of the valve is open to allow the cooling water to pass through the radiator bypass passage 19. Thus, the flow switching valve 15 switches over the flow paths of the cooling water.

Also, the communication passage indicated by the reference numeral 21 between the heater core 7 and the engine body 3 on the right side of FIG. 1 is also a part of the cooling water external passage 11 and extends straight toward the inlet port 7*a* of the passenger room heater core 7 from the heater side opening 12*a* of the water jacket 12. The communication passage 21 is adapted to cause the cooling water to flow toward the heater core 7 from the engine body 3. Accordingly, this communication passage will be referred to as a heater core directed communication passage 21.

A thermostat type flow rate control valve 23 is disposed substantially in the middle portion M of the heater core directed communication passage 21.

The structures of the above-described flow passage switching valve 15 and the flow rate control valve 23 are well known. Therefore, their detailed explanation will be omitted.

The flow rate control valve 23 is opened to allow the cooling water to flow when the temperature of the cooling water exceeds a heater water passage limit temperature $T_2$, and the flow rate control valve 23 is closed to stop the flow of the cooling water when the temperature of the cooling water is not higher than the heater water passage limit temperature $T_2$. Incidentally, the flow rate control valve 23 does not cause no cooling water to flow even if the flow rate control valve 23 is closed. Even if the flow rate control valve 23 is closed, a small amount of the cooling water may flow through small holes (not shown) for detecting the temperature. More exactly, it can be said that the amount of the cooling water flowing through the heater core directed communication passage 21 is reduced by the flow rate control valve 23 in the case where the temperature of the cooling water is not higher than the heater water passage limit temperature $T_2$. In the flow rate control valve 23, the cooling water flows by about 0.5 liter per minute, for example.

Incidentally, the heater water passage limit temperature $T_2$ of the flow rate control valve 23 is set to be not higher than the radiator water passage allowance temperature $T_1$ of the flow passage switching valve 15. For instance, the radiator water passage allowance temperature $T_1$ is set at 82° C. and the heater water passage limit temperature $T_2$ is set at 60° C.

Also, the above-described engine body directed communication passage 14 and the above-described heater core directed communication passage 21 are communicated with each other through an oil cooler cooling water communication passage 30 including the oil cooler 9. This oil cooler cooling water communication passage 30 is also a part of the communication passage constituting the cooling water external passage 11.

A radiator side end 30*a* of the oil cooler cooling water communication passage 30 is connected at a downstream portion of the water pump 17 of the engine body directed communication passage 14. Also, a heater core side end 30*b* of the oil cooler cooling water communication passage 30 is connected at a joint C upstream of an inlet 13*a* of the flow rate control valve 23 and the radiator directed communication passage 13 in the heater core directed communication passage 21.

Incidentally, in this embodiment, the oil cooler cooling water communication passage 30 is provided outside of the engine body 3 as a part of the cooling water external passage 11. However, it is possible to provide the oil cooler cooling water communication passage 30 in the interior of the engine body 3 separately from the water jacket 12.

Furthermore, another communication passage constituting the cooling water external passage 11 is a communication passage 32 for connecting an outlet 7*b* of the passenger room heater core 7 and the engine body directed communication passage 14. The communication passage 32 is adapted to return the cooling water, that has been introduced into the heater core 7, back to the water pump 17. Also, the joint point between the communication passage 32 and the engine body directed communication passage 14 is located between the above-described flow passage switching valve 15 and the above-described water pump 17.

Then, the cooling water may be recirculated between the radiator 5 and the engine body 3 and between the passenger room heater core 7 and the engine body 3 through the respective communication passages 13, 14, 19, 21, 30 and 32.

Also, an electric heater (auxiliary heating means) 34 for heating the cooling water that flows through the water jacket 12 is provided in the vicinity of and above the heater side opening 12*a* in the water jacket 12 of the engine 1. The electric heater 34 works when the temperature of the cooling water is not higher than an auxiliary heating upper limit temperature $T_3$. The electric heater 34 is controlled not to work when its temperature exceeds the auxiliary heating upper limit temperature $T_3$. In this case, in this embodiment, the auxiliary heating upper limit temperature $T_3$ is higher than the heater water passage limit temperature $T_2$ of the flow rate control valve 23 but lower than the radiator water passage allowance temperature $T_1$ of the flow passage switching valve 15 ($T_1>T_3>T_2$). However, with respect to the relationship between the radiator water passage allowance temperature $T_1$ and the auxiliary heating upper limit temperature $T_3$, it is possible to set the auxiliary heating upper limit temperature $T_3$ to be higher than the radiator water passage allowance temperature $T_1$ ($T_3>T_1>T_2$).

Furthermore, a water temperature sensor 36 for detecting the temperature of the cooling water is disposed at a position away from the electric heater 34 in the water jacket 12 of the engine 1.

The cooling water recirculation apparatus A for the internal combustion engine according to this embodiment of the present invention is thus constructed.

In such a cooling water recirculation apparatus A for an internal combustion engine, between the radiator 5 and the engine body 3, the cooling water discharged from the heater side opening 12*a* of the water jacket 12 is introduced into the heater core directed communication passage 21. Immediately thereafter, the cooling water is introduced into the radiator directed communication passage 13. Thereafter, the cooling water is introduced into the radiator 5 and is returned back to the water jacket 12 through the engine body directed communication passage 14 if the flow passage switching valve 15 opens on the radiator 5 side. The passage through which the cooling water is thus recirculated is referred to as a radiator side cooling water recirculation circuit E. Incidentally, if the radiator 5 side of the flow passage switching valve 15 is closed and the radiator bypass passage 19 side of the valve 15 is opened thereby, the cooling water is not allowed to flow through the radiator 5.

Since the engine body directed communication passage 14 is also in communication with the oil cooler cooling water communication passage 30, when the cooling water is recirculated through the radiator side cooling water recirculation circuit E, the cooling water is also allowed to flow through the oil cooler cooling water communication passage 30. The cooling water that has been introduced into the oil cooler cooling water communication passage 30 is discharged upstream of the flow rate control valve 23 in the heater core directed communication passage 21.

Also, between the passenger room heater core 7 and the engine body 3, the cooling water that has been discharged from the heater side opening 12*a* of the water jacket 12 is introduced into the heater core directed communication passage 21. Thereafter, if the flow rate control valve 23 is opened, the cooling water passes through the flow rate control valve 23 to reach the passenger room heater core 7. The cooling water is introduced into the engine body directed communication passage 14 through the communication passage 32 for connecting the heater core 7 and the engine body directed communication passage 14 to each other. The cooling water is returned back to the water jacket 12 through the engine body directed communication passage 14. The passage through which the cooling water is thus recirculated will be referred to as a heater side cooling water recirculation circuit F. Even when the cooling water is recirculated through the heater side cooling water recirculation circuit F, the cooling water may flow through the oil cooler cooling water communication passage 30.

On the other hand, if the flow rate control valve 23 is closed, the cooling water is not allowed to flow through the heater core 7. As described above, since the temperature at which the flow rate control valve 23 is closed (i.e., the heater water passage limit temperature $T_2$) is set to be not higher than the temperature at which the flow passage switching valve 15 closes the radiator 5 side (i.e., the radiator water passage allowance temperature $T_1$), when the flow rate control valve 23 is closed, the flow passage switching valve 15 always close the radiator 5 side and opens the radiator bypass passage 19 side. Accordingly, at this time, the cooling water is not allowed to flow through the radiator 5 or the heater core 7. The cooling water discharged from the radiator side opening 12*c* of the water jacket 12 is caused to pass through the radiator bypass passage 19 and is returned back to the water jacket 12 through the engine body directed communication passage 14. Thus, the passage through which the cooling water is recirculated while bypassing the radiator 5 will be referred to as a radiator bypass circuit G. Incidentally, even if it is described that the cooling water is not allowed to flow through the heater core 7, as described above, an extremely small amount of cooling water for detecting the temperature is allowed to flow through the heater core 7 and to be recirculated through the heater side cooling water recirculation circuit F.

Even if the cooling water is recirculated through the radiator bypass circuit G, the cooling water is also allowed to flow through the oil cooler cooling water communication passage 30.

The advantage of the cooling water recirculation apparatus A for the internal combustion engine in accordance with this embodiment of the present invention will be described.

In operation of the engine 1, when the temperature of the cooling water is not higher than the heater water passage limit temperature $T_2$, as described above, the flow rate control valve 23 is closed, and the flow passage switching valve 15 closes the radiator 5 side but opens the radiator bypass passage 19 side. Accordingly, the cooling water is not allowed to flow through the radiator 5 or the heater core 7. The cooling water is simply recirculated through the radiator bypass circuit G via the radiator bypass passage 19.

Incidentally, since the fact that the temperature of the cooling water is not higher than the heater water passage limit temperature $T_2$ means that the temperature of the cooling water is not higher than the auxiliary heating upper limit temperature $T_3$ of the electric heater 34 ($T_3>T_2$), the electric heater 34 works.

Accordingly, when the cooling water is recirculated through the radiator bypass circuit G, the cooling water that flows through the water jacket 12 absorbs the heat from the engine 1 and also absorbs the heat from the electric heater 34. Also, since a large amount of cooling water flows through the portion where the electric heater 34 is installed, the heat transfer may be effectively carried out. Accordingly, there is no fear that only the cooling water in the vicinity of the electric heater 34 should be locally heated up to an abnormally high temperature. Also, there is not fear that the heat irradiation from the engine surface should be accelerated in this portion.

Also, in this case, since the extremely small amount of the cooling water only flows through the heater core 7 for the detection of the temperature, the heat irradiation amount in the heater core 7 is extremely small.

As a result, it is possible to rapidly elevate the temperature of the cooling water that is recirculated through the radiator bypass circuit G, and at the same time to rapidly elevate the cylinder bore walls of the engine to thereby considerably reduce a time needed to warm up the engine 1 until a regular operation.

Also, since the extremely small amount of the cooling water only flows through the heater core 7 for the detection of the temperature, it is possible to prevent cold air from blowing into the passenger room for a long period of time when the temperature of the cooling water is low.

Furthermore, if the engine 1 is provided with an exhaust gas recirculation system (so-called EGR) for returning a part of the exhaust gas back to the mixture of the intake system, the earlier warming-up operation is carried out so that the recirculation of the exhaust gas may be performed in the earlier stage.

Also, since the cooling water flows also through the oil cooler cooling water communication passage 30, it is possible to quickly elevate the temperature of the lubricant oil for the engine 1.

Subsequently, when the warming-up operation is accelerated and the temperature of the cooling water is elevated so that the temperature exceeds the heater water passage limit temperature $T_2$ of the flow rate control valve 23, the flow rate control valve 23 is opened and the recirculation of the cooling water is performed also between the engine body 3 and the passenger room heater core 7 through the heater side cooling water recirculation circuit F. At this time, since the temperature of the cooling water has been already well elevated, the sufficient irradiation of the heat from the heater core 7 is performed and warm air is blown into the passenger room.

Even if the temperature of the cooling water exceeds the heater water passage limit temperature $T_2$, since the electric heater 34 works if the temperature is not higher than the auxiliary heating upper limit temperature $T_3$, the cooling water absorbs the heat from the engine 1 and also absorbs the heat from the electric heater 34 also during the recirculation through the heater side cooling water recirculation circuit F. Accordingly, even if the heat receiving amount of the cooling water after the warming-up operation is large, and the flow rate control valve 23 is fully opened so that the large amount of the cooling water flows through the heater core 7, there is no fear that the temperature of the cooling water is lowered. Thus, the passenger room heater may work quickly. It is also possible to avoid the degradation of the fuel consumption rate.

Also, the temperature of the cooling water at an equilibrium in which the heat receiving amount of the cooling water is in balance with the heat irradiation amount in the heater core 7 made higher, and the heat irradiation amount from the heater core 7 is increased. Therefore, the passenger room heater extremely well work.

The above-described advantage may be insured in the same manner also in an engine such as a so-called direct injection engine in which fuel is injected directly into a combustion chamber and is low in heat generation.

Thereafter, when the temperature of the cooling water is further elevated, so that the temperature exceeds the auxiliary heating upper limit temperature $T_3$, the operation of the electric heater 34 is stopped.

Then, when the temperature of the cooling water is further elevated and the temperature exceeds the radiator water passage allowance temperature $T_1$, the flow passage switching valve 15 closes the radiator bypass passage 19 side but opens the radiator 5 side so that the cooling water is not allowed to flow through the radiator bypass passage 19. The recirculation of the cooling water is effected also between the radiator 5 and the engine body 3 through the radiator side cooling water recirculation circuit E. The temperature of the cooling water is adjusted so as to be suitable for the operational condition of the engine 1 by the radiator 5.

In the foregoing embodiment, the electric heater 34 is disposed in the vicinity of and above the heater side opening 12*a* within the water jacket 12 of the engine 1. However, the position of the electric heater 34 is not limited thereto. In brief, it is sufficient to install the heater to a place where the cooling water flows when the flow rate control valve 23 is closed and the cooling water is recirculated through the radiator bypass circuit G. It is more preferable to install the heater to a place where a high flow rate of the cooling water is present.

Figure 2:
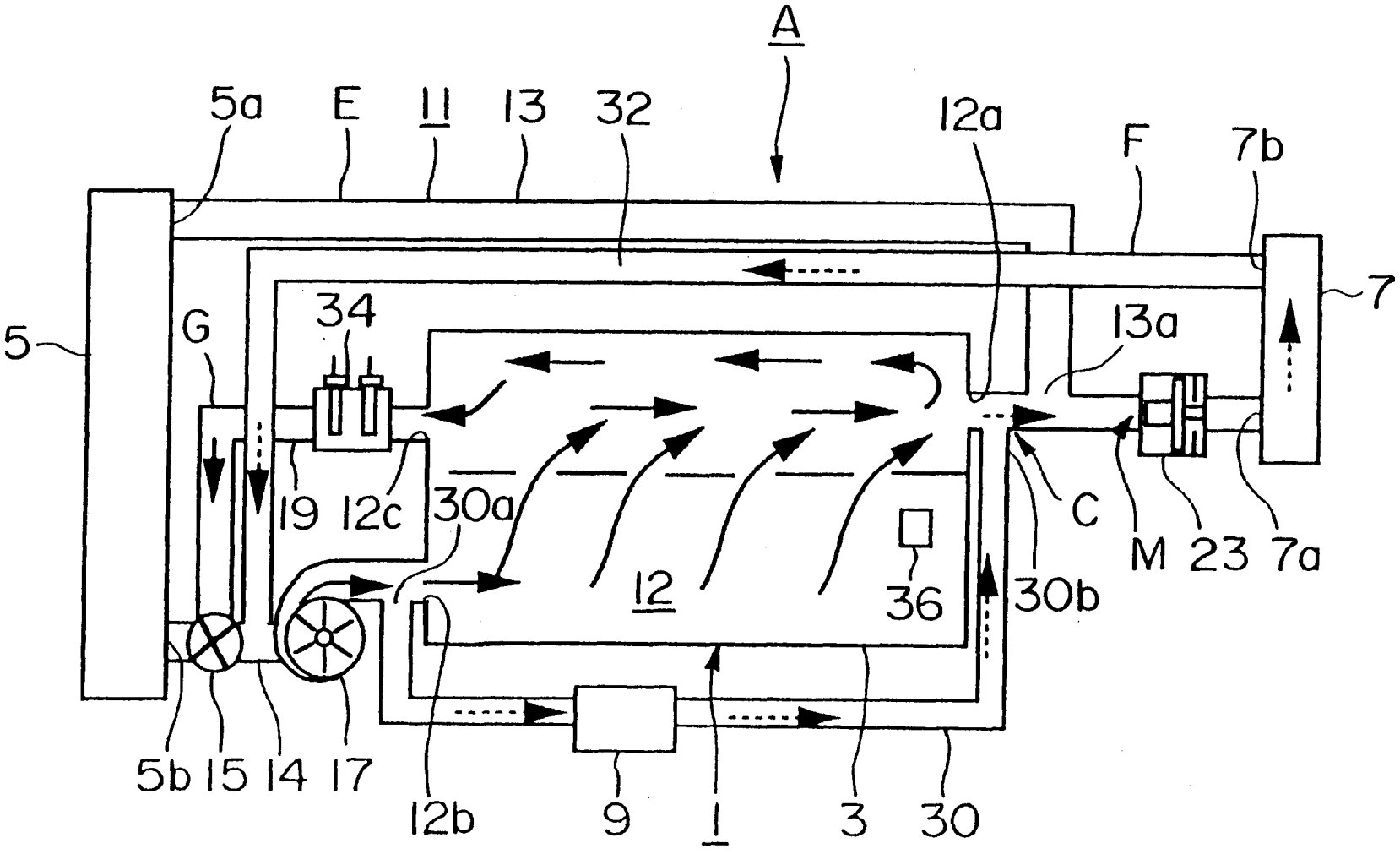
FIG. 2 is a view showing another embodiment of the present invention.
Figure 3:
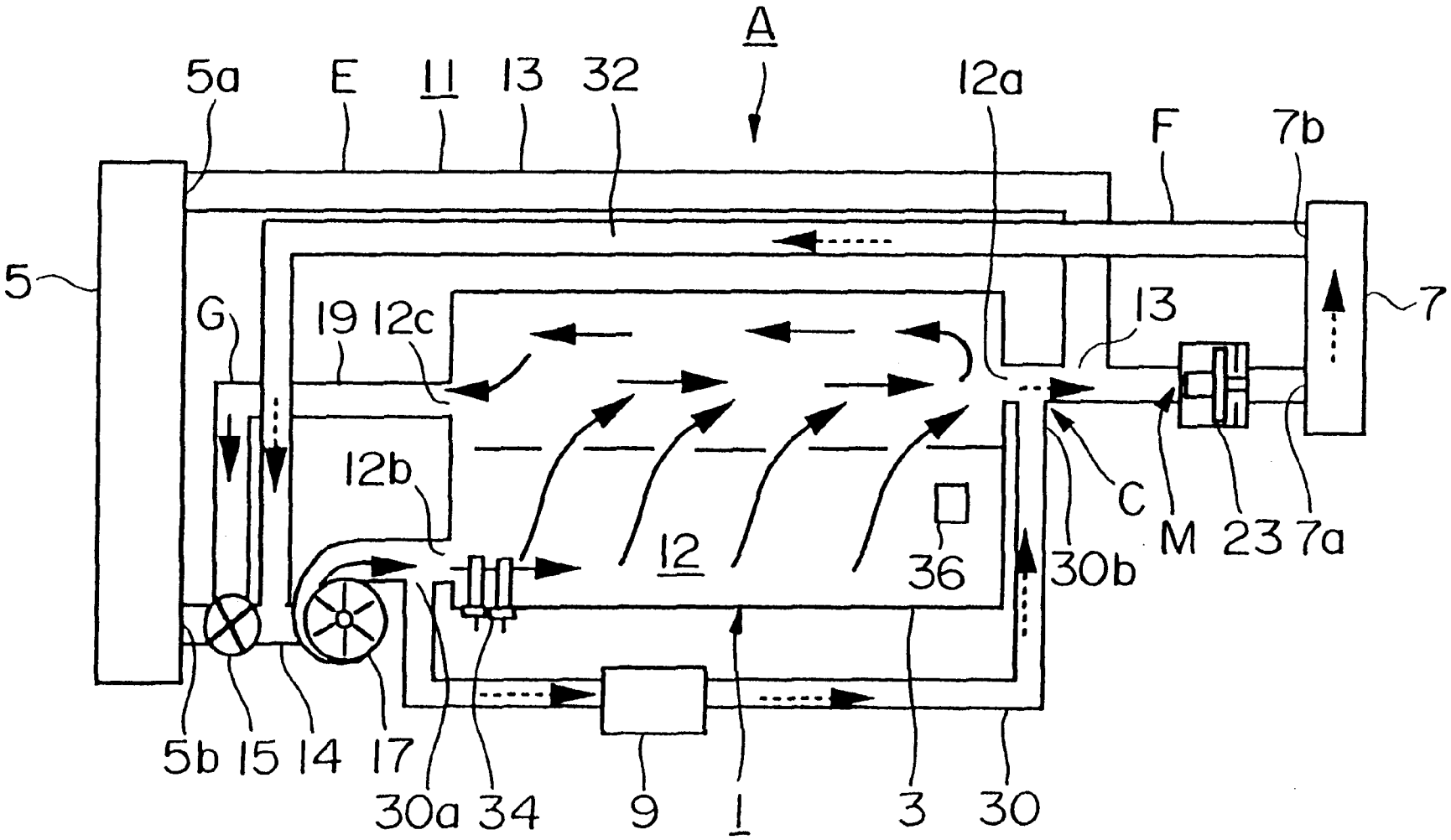
FIG. 3 is a view showing still another embodiment of the present invention.

FIGS. 2 and 3 show examples in which the installation place of the electric heater 34 is changed. FIG. 2 shows a case where the electric heater 34 is installed in the midway of the radiator bypass passage 19. FIG. 3 shows a case where the electric heater 34 is disposed in the vicinity of the radiator side opening 12*b* in the water jacket 12 of the engine 1.

Figure 4:
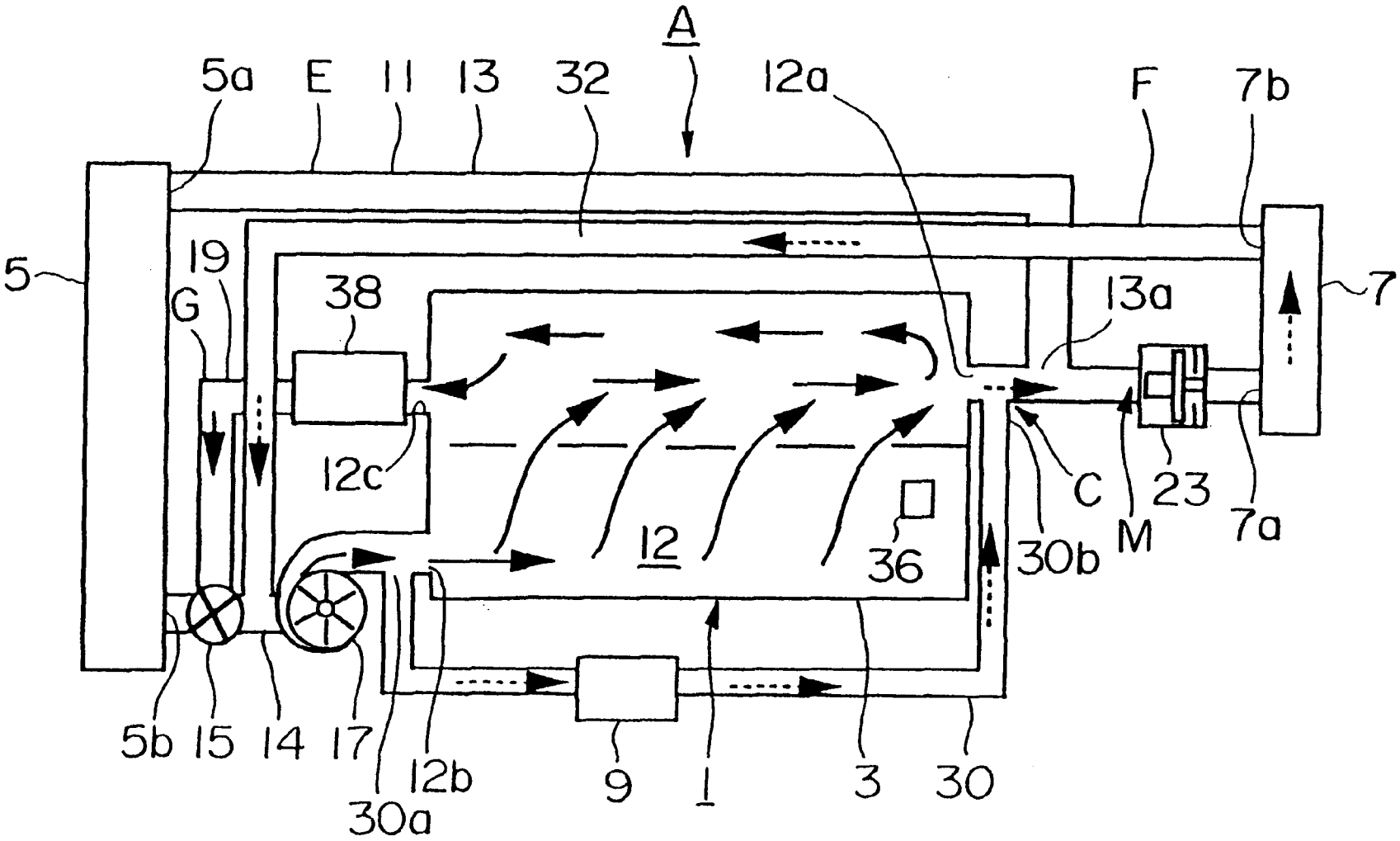
FIG. 4 is a view showing still another embodiment of the present invention.
Figure 5:
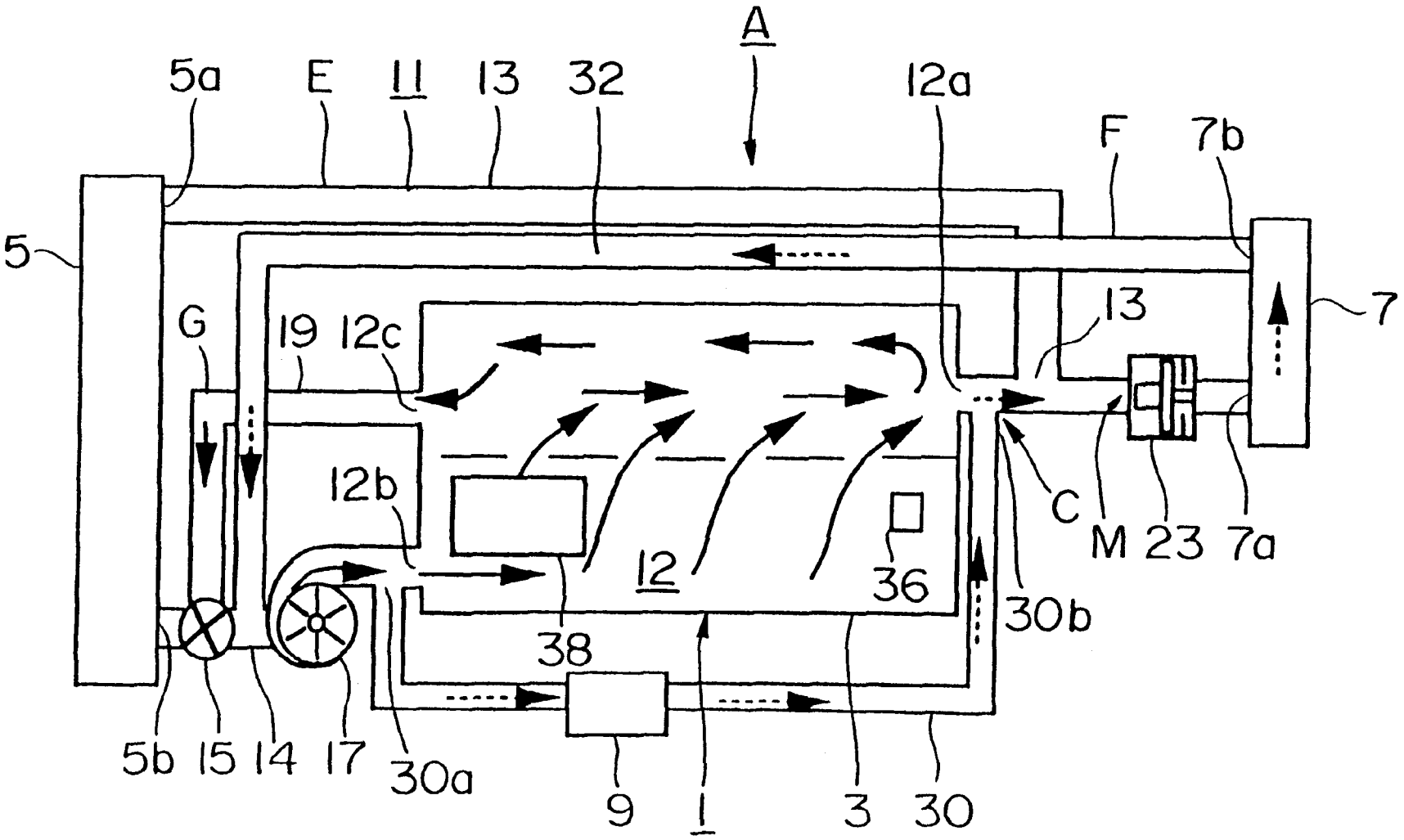
FIG. 5 is a view showing still another embodiment of the present invention.

Also, it is possible to use a burning type heater instead of the electric heater 34. FIG. 4 shows an example in which a heat exchanger 38 of the burning type heater is disposed in the midway of the radiator bypass passage 19. FIG. 5 shows an example in which the heat exchanger 38 of the burning type heater is disposed in the vicinity of the radiator side opening 12*b* in the water jacket 12 of the engine 1. Incidentally, needless to say, the heat exchanger 38 of the burning type heater may be disposed in the vicinity of the heater side opening 12*a* in the water jacket 12 in the same manner as in the embodiment of FIG. 1.

As described above, according to the present invention, there is provided a cooling water recirculation apparatus for an internal combustion engine, comprising: an internal combustion engine body; a radiator; a passenger room heater; a radiator side cooling water recirculation circuit; a heater side cooling water recirculation circuit; a radiator bypass circuit; an auxiliary heating means; a cooling water passage switching means for closing the radiator bypass circuit when a temperature of the cooling water exceeds a radiator water passage allowance temperature, thereby allowing the cooling water to flow through the radiator side cooling water recirculation circuit, and for closing the radiator side cooling water recirculation circuit when the temperature of the cooling water is not higher than the radiator water passage allowance temperature, thereby allowing the cooling water to flow through the radiator bypass circuit; and a flow rate control valve provided downstream of the cooling water internal passage of the internal combustion engine body and upstream of the passenger room heater in the heater side cooling water recirculation circuit, for reducing an amount of the cooling water flowing through the heater side cooling water recirculation circuit when the temperature of the cooling water is not higher than a heater water passage limit temperature that is set to be not higher than the radiator water passage allowance temperature, characterized in that the auxiliary heating means is provided in a place where the cooling water is recirculated when the temperature of the cooling water is not higher than the heater water passage allowance temperature. Accordingly, it is possible to elevate the temperature of the cooling water in an early stage, and to shorten a warming-up time to make it possible to improve the effect of the passenger room heater after the warming-up operation.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A cooling water recirculation apparatus for an internal combustion engine, comprising:

an internal combustion engine body having a cooling water internal passage for cooling a portion around a cylinder;

a radiator for irradiating heat of said internal combustion engine body, absorbed by the cooling water, to atmosphere;

a passenger room heater using a part of the cooling water as a heat medium;

a radiator side cooling water recirculation circuit for recirculating the cooling water between said cooling water internal passage of said internal combustion engine body and said radiator;

a heater side cooling water recirculation circuit for recirculating the cooling water between said cooling water internal passage of said internal combustion engine body and said heater;

a radiator bypass circuit for returning the cooling water, that has been discharged from said cooling water internal passage of said internal combustion engine body, back to said cooling water internal passage, bypassing said radiator;

a cooling water passage switching means for closing said bypass circuit when a temperature of the cooling water exceeds a radiator water passage allowance temperature, thereby allowing the cooling water to flow through said radiator side cooling water recirculation circuit, and for closing said radiator side cooling water recirculation circuit when the temperature of the cooling water is not higher than the radiator water passage allowance temperature, thereby allowing the cooling water to flow through said radiator bypass circuit;

an auxiliary heating means for heating the cooling water, provided separately from said internal combustion engine body and not located in the heater side cooling water recirculation circuit; and a flow rate control valve provided downstream of said cooling water internal passage of said internal combustion engine body and upstream of said passenger room heater in said heater side cooling water recirculation circuit, for reducing an amount of the cooling water flowing through said heater side cooling water recirculation circuit when the temperature of the cooling water is not higher than a heater water passage limit temperature that is set to be not higher than the radiator water passage allowance temperature;

wherein said auxiliary heating means is provided in a portion of one of the cooling water internal passage and the radiator bypass circuit where cooling water heated by said auxiliary heating means flows into said heater side cooling water recirculation circuit without first being recirculated through said cooling water internal passage.

2. A cooling water recirculation apparatus according to claim 1, the cooling water flow passage switching means is a thermostat or a thermostat type flow passage switching value for switching the flow passage by using the radiator water passage allowance temperature as a threshold value.

3. A cooling water recirculation apparatus according to claim 1, the flow rate control value is a thermostat or a thermostat type flow rate control valve for opening and closing by using the heater water passage limit temperature as a threshold value.

4. A cooling water recirculation apparatus according to claim 1, wherein when the cooling water is warmed up so that said flow rate control valve is opened, the cooling water is recirculated through said heater side cooling water recirculation circuit, and when the cooling water is cooled so that said flow rate control valve is closed, the cooling water is not recirculated through said heater side cooling water recirculation circuit.

5. A cooling water recirculation apparatus according to claim 1, wherein said flow rate control valve allows a small amount of the cooling water to flow for detecting temperature when said flow rate control valve is in the closed condition.

6. A cooling water recirculation apparatus according to claim 1, wherein said heater water passage limit temperature for controlling the opening/closing of said flow rate control valve is set to be equal to or lower than said radiator water passage allowance temperature for controlling the flow passage switching of said cooling water passage switching means, and when said flow rate control valve is closed and the cooling water is not recirculated through said heater side cooling water recirculation circuit, said radiator side cooling water recirculation circuit is closed and the cooling water is not recirculated through said radiator side cooling water recirculation circuit.

* * * * *

UNITED STATES PATENT AND TRADEMARK OFFICE

CERTIFICATE OF CORRECTION

PATENT NO. : 6,325,026 B1
DATED : December 4, 2001
INVENTOR(S) : Makoto Suzuki

It is certified that error appears in the above-identified patent and that said Letters Patent is hereby corrected as shown below:

Column 1,
Line 28, change “less works.” to -- works less well. --

Column 3,
Line 37, change “well works.” to -- works well --.

Column 4,
Line 25, change “blow” to -- flow --.

Column 6,
Line 43, change “not to work” to -- to not work --.

Column 10,
Line 30, change “allowance temperature” to -- limit temperature --.

Signed and Sealed this

Ninth Day of March, 2004

JON W. DUDAS
*Acting Director of the United States Patent and Trademark Office*